US008377228B2

(12) United States Patent
Mersch et al.

(10) Patent No.: US 8,377,228 B2
(45) Date of Patent: Feb. 19, 2013

(54) WASH FLUID DISTRIBUTION AND FILTRATION ASSEMBLY AND METHOD

(75) Inventors: Matt D. Mersch, Louisville, KY (US); Joseph Duane Tobbe, Taylorsville, KY (US); Gregory Miller, Louisville, KY (US)

(73) Assignee: General Electric Company, Schenectady, NY (US)

( * ) Notice: Subject to any disclaimer, the term of this patent is extended or adjusted under 35 U.S.C. 154(b) by 907 days.

(21) Appl. No.: 11/636,028

(22) Filed: Dec. 8, 2006

(65) Prior Publication Data

US 2008/0135067 A1 Jun. 12, 2008

(51) Int. Cl.
*B08B 3/00* (2006.01)

(52) U.S. Cl. ..... 134/56 D; 134/57 D

(58) Field of Classification Search ..... None
See application file for complete search history.

(56) References Cited

U.S. PATENT DOCUMENTS 4,150,679 A * 4/1979 Cushing et al. ..... 134/104.1
4,754,770 A * 7/1988 Fornasari ..... 134/57 D
5,909,743 A 6/1999 Thies et al.
6,103,017 A 8/2000 Thies et al.
6,182,674 B1 2/2001 Jozwiak et al.
6,605,157 B2 8/2003 Hegeman
6,615,853 B2 9/2003 Hegeman et al.
6,698,438 B2 * 3/2004 Hegeman et al. ..... 134/110
6,782,899 B2 8/2004 Kim et al.
6,832,617 B2 12/2004 Hegeman et al.
6,871,653 B2 * 3/2005 Christman et al. ..... 134/22.1
6,997,193 B2 2/2006 Elick et al.
2004/0103926 A1 * 6/2004 Ha ..... 134/57 D

* cited by examiner

*Primary Examiner* — Michael Barr
*Assistant Examiner* — Jason Ko
(74) *Attorney, Agent, or Firm* — Global Patent Operation; Douglas D. Zhang

(57) ABSTRACT

A fluid filtration assembly for a dishwasher system includes at least one spray arm assembly configured to distribute fluid within a wash chamber, and a filter assembly including a filter body defining a fluid inlet and a soil outlet thereon. A soil collection chamber is coupled in flow communication with the soil outlet and is configured to receive soil filtered by the filter assembly. A pump is configured to direct fluid to one of the spray arm assembly and the soil collection chamber. A valve assembly is movable between a first position and a second position. The valve assembly is coupled in flow communication with the spray arm assembly and the soil collection chamber. In the first position, the pump is configured to direct fluid to the at least one spray arm assembly. In the second position, the pump is configured to direct fluid into the soil collection chamber.

20 Claims, 6 Drawing Sheets

WASH FLUID DISTRIBUTION AND FILTRATION ASSEMBLY AND METHOD

BACKGROUND OF THE INVENTION

This invention relates generally to dishwashers and, more particularly, to methods and appliances for circulating fluid in dishwashers.

Conventional dishwasher systems include a main pump assembly and a drain pump assembly for circulating and draining wash fluid, respectively, within a wash chamber defined within the dishwasher system. The main pump assembly feeds wash fluid to various spray arm assemblies for distribution throughout the wash chamber to wash soiled items loaded into dishwasher racks positioned within the wash chamber. Wash fluid sprayed onto the dishwasher items is collected in a sump located in a lower portion of the wash chamber, and water entering the sump is filtered through one or more coarse filters to remove soil and/or sediment from the wash fluid. At least some conventional dishwasher systems further include a filter system in flow communication with the main pump assembly to remove soil and/or sediment of a smaller particle size than those particles filtered by the coarse filters. The main pump assembly draws wash fluid from the sump to re-circulate in the wash chamber, and the coarse and fine filters are used to continuously filter the water in the sump during the re-circulation process. However, a drain pump and a main pump occupy a considerable amount of space within the dishwasher and increase the manufacture cost.

BRIEF DESCRIPTION OF THE INVENTION

In one aspect, a fluid filtration assembly for a dishwasher system is provided. The dishwasher system includes a tub defining a washing chamber configured to receive dishwasher contents. The fluid filtration assembly includes at least one spray arm assembly configured to distribute fluid within the wash chamber, and a filter assembly including a filter body defining a fluid inlet and a soil outlet thereon. A soil collection chamber is coupled in flow communication with the soil outlet and configured to receive soil filtered by the filter assembly. A pump is configured to direct fluid to the at least one spray arm assembly and/or the soil collection chamber. A valve assembly is movable between a first position and a second position and coupled in flow communication with the spray arm assembly and the soil collection chamber. With the valve assembly in the first position, the pump is configured to direct fluid to the at least one spray arm assembly. With the valve assembly in the second position, the pump is configured to direct fluid into the soil collection chamber.

In another aspect, a dishwasher is provided. The dishwasher includes a tub defining a wash chamber. At least one spray arm assembly is positioned within the wash chamber and is configured to distribute fluid within the wash chamber. A filter assembly is positioned within the wash chamber. The filter assembly includes a fluid inlet and a drain tube coupled in flow communication with the fluid inlet. A soil collection chamber is coupled in flow communication with the drain tube and is configured to receive filtered particles from the filter assembly. A pump is configured to selectively direct fluid through the at least one spray arm assembly and/or the soil collection chamber. A valve assembly is movable between a wash position and a drain position. In the wash position, the valve assembly provides flow communication between the pump and the spray arm assembly. In the drain position, the drain valve assembly provides flow communication between the pump and the soil collection chamber.

In still another aspect, a method for filtering wash fluid within a dishwasher system is provided. The dishwasher system includes a tub defining a wash chamber and at least one spray arm assembly positioned within the wash chamber. The spray arm assembly is configured to distribute fluid within the wash chamber. The method includes positioning a filter assembly within the wash chamber. The filter assembly defines a fluid inlet and a fluid outlet and includes a drain tube coupled with the fluid outlet. The method includes coupling a soil collection chamber to the filter assembly. The soil collection chamber is in flow communication with the drain tube and is configured to receive filtered soil particles from the filter assembly. The method also includes operatively coupling a pump with the at least one spray arm assembly and the soil collection chamber, and operatively coupling a valve assembly to the pump. The pump is configured to selectively direct fluid to the at least one spray arm assembly and/or the soil collection chamber. The valve assembly is movable between a first position to provide flow communication between the pump and the at least one spray arm assembly and a second position to provide flow communication between the pump and the soil collection chamber.

DETAILED DESCRIPTION OF THE INVENTION

Figure 1:
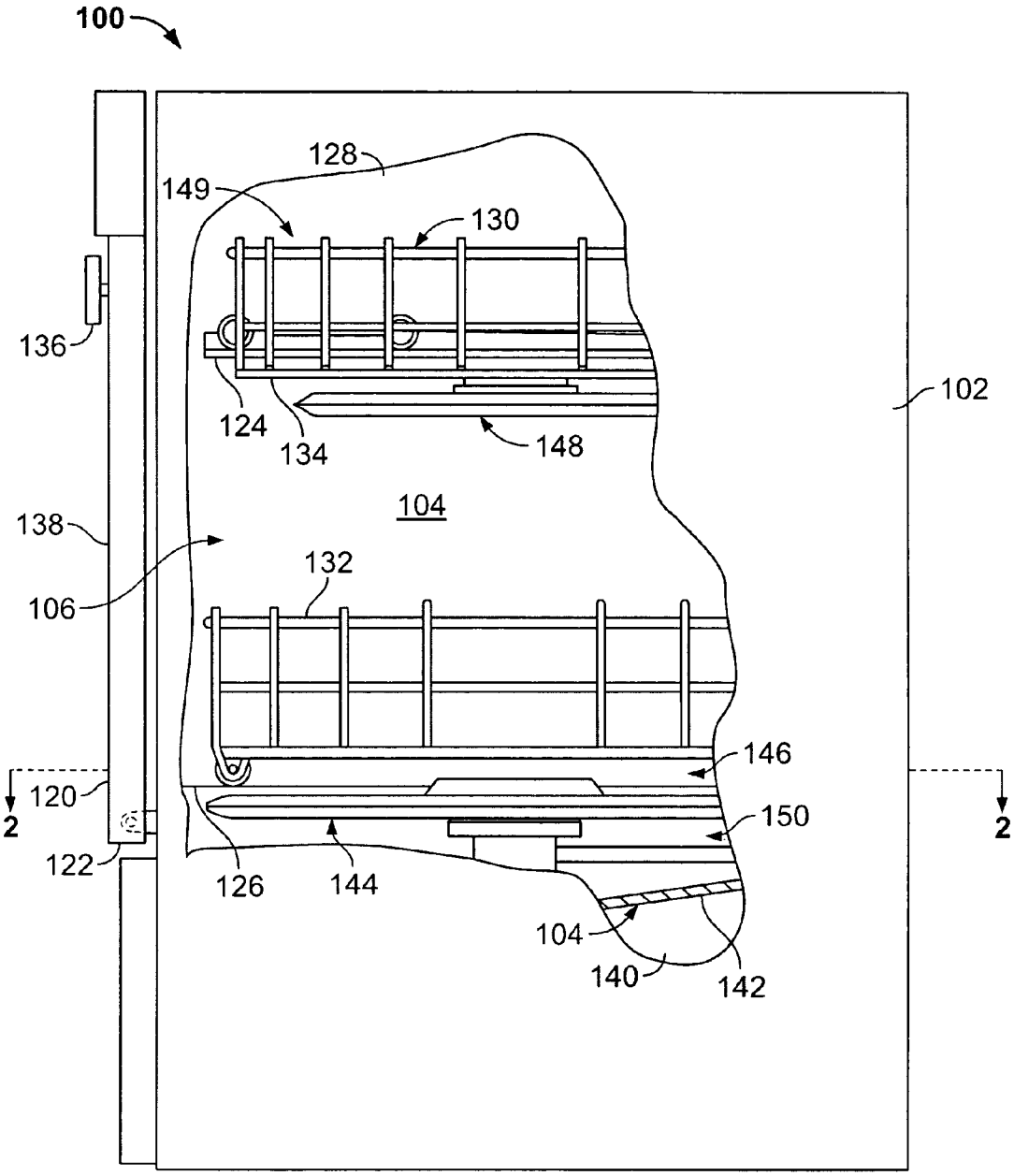
FIG. 1 is a side elevational view of an exemplary dishwasher system with a portion of a cabinet sidewall removed.

FIG. 1 is a side elevational view of an exemplary dishwasher system 100 with a portion of a cabinet sidewall removed. It should be apparent to those skilled in the art and guided by the teachings herein provided that the wash fluid distribution and filtration assembly described herein may be suitable for incorporation with other types of dishwashers and dishwasher systems. Accordingly, the following description is for illustrative purposes only and in no way limits use of the described assemblies and methods to a particular type of dishwasher system.

Dishwasher system 100 includes a cabinet 102 having a tub 104 forming a wash chamber 106. Tub 104 includes a front opening (not shown in FIG. 1) and a door 120 hinged at a bottom portion 122 for movement between a closed position (shown in FIG. 1) wherein door 120 sealingly closes wash chamber 106 for washing operation, and an open position (not shown) for loading and unloading of dishwasher contents.

Upper and lower guide rails 124, 126 are mounted on tub side walls 128 and accommodate upper and lower roller-equipped racks 130, 132, respectively. Each of upper and lower racks 130, 132 is fabricated from known materials into lattice structures including a plurality of elongate members 134, and each rack 130, 132 is adapted for movement between an extended loading position (not shown) in which the rack is substantially positioned outside wash chamber 106, and a retracted position (shown in FIG. 1) in which the rack is located inside wash chamber 106. A silverware basket (not shown) is removably attached to lower rack 132 for placement of silverware, utensils and the like that are too small to be accommodated by upper and lower racks 130, 132.

A control input selector 136 is mounted at a convenient location on an outer face 138 of door 120 and is operatively coupled to known control circuitry (not shown) and control mechanisms (not shown) for operating a fluid distribution assembly for circulating water and dishwasher fluid in dishwasher tub 104. The fluid distribution assembly, as described below, is located in a machinery compartment 140 located below a bottom sump portion 142 of tub 104.

A lower spray arm assembly 144 is rotatably mounted within a lower region 146 of wash chamber 106 and above tub sump portion 142 such that lower spray arm assembly 144 rotates in relatively close proximity to lower rack 132. A mid-level spray arm assembly 148 is located in an upper region 149 of wash chamber 106 and is positioned in close proximity to upper rack 130 at a sufficient height above lower rack 132 such that lower rack 132 accommodates larger items, such as a dish, pot and/or platter (not shown). In a further embodiment, an upper spray arm assembly (not shown) is located above upper rack 130.

Lower spray arm assembly 144 and mid-level spray arm assembly 148 are fed by a fluid distribution assembly 150. Each spray arm assembly 144, 148 includes an arrangement of discharge ports or orifices for directing wash fluid onto dishes located in lower rack 132 and upper rack 130, respectively. The arrangement of the discharge ports in at least lower spray arm assembly 144 provides a rotational force as wash fluid is directed to flow through the discharge ports. The resultant rotation of lower spray arm assembly 144 distributes wash fluid to cover dishes and other contents with a washing spray. In alternative embodiments, mid-level spray arm assembly 148 and/or the upper spray arm are also rotatably mounted and configured to generate a swirling spray pattern above and/or below upper rack 130 when fluid distribution assembly 150 is activated.

Figure 2:
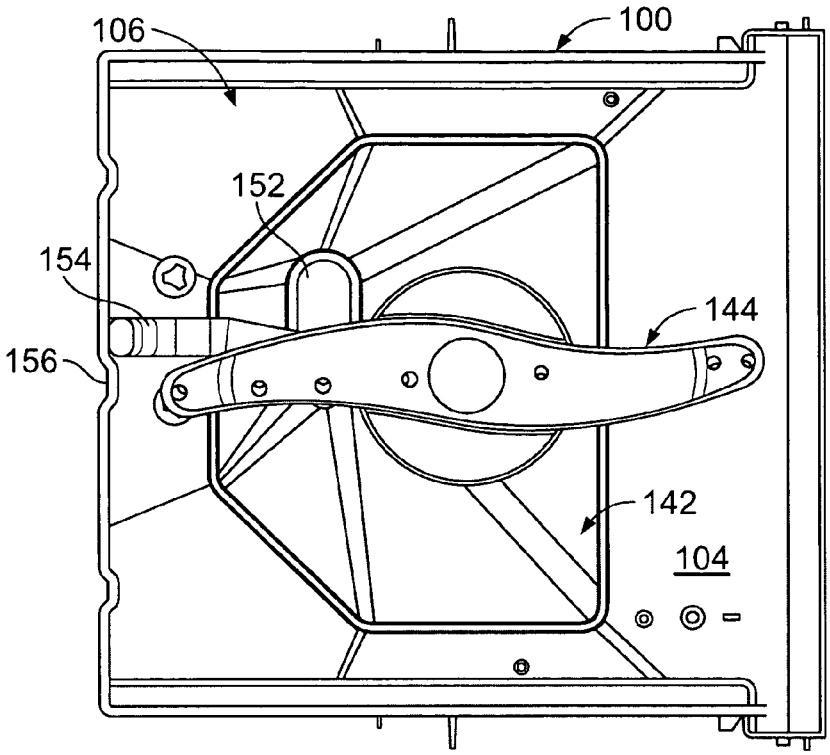
FIG. 2 is a top plan view of a portion of a wash chamber of the dishwasher system shown in FIG. 1 along line 2-2.

FIG. 2 is a top plan view of dishwasher system 100 along sectional line 2-2 shown in FIG. 1 above lower spray arm assembly 144. Tub 104 is generally downwardly sloped beneath lower spray arm assembly 144 toward tub sump portion 142. Tub sump portion 142 is generally downwardly sloped toward a sump assembly 152 in flow communication with fluid distribution assembly 150, shown in FIG. 1. Lower spray arm assembly 144 is substantially centered within tub 104 and wash chamber 106 and positioned above tub 104 and tub sump portion 142 to facilitate free rotation of lower spray arm assembly 144.

Tub 104 and tub sump portion 142 are downwardly sloped toward sump assembly 152 so that water sprayed from lower spray arm assembly 144, mid-level spray arm assembly 148 and the upper spray arm assembly is collected in tub sump portion 142 and directed toward sump assembly 152 for filtering and re-circulation, as described below, during an exemplary dishwasher system wash cycle. In addition, a conduit 154 extends beneath lower spray arm assembly 144 and is in flow communication with fluid distribution assembly 150. Conduit 154 extends to a back wall 156 of wash chamber 106, and upward along back wall 156 for feeding wash fluid to mid-level spray arm assembly 148 and/or the upper spray arm assembly.

Figure 3:
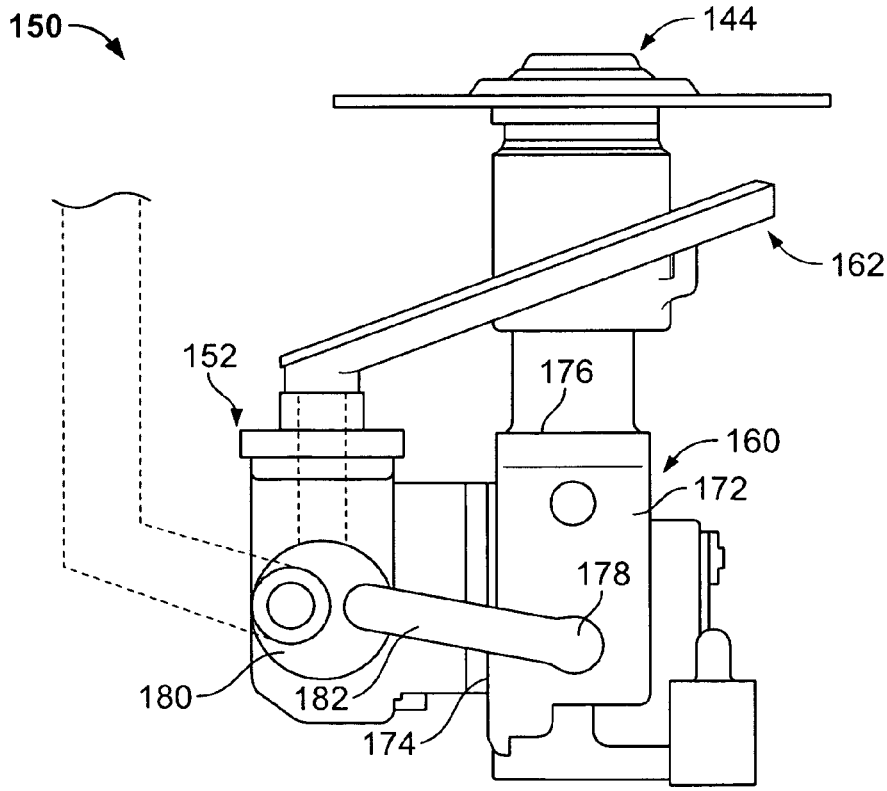
FIG. 3 is a side elevational view of an exemplary fluid distribution assembly for the dishwasher system shown in FIG. 1.

FIG. 3 illustrates exemplary fluid distribution assembly 150 positioned below lower spray arm assembly 144. Fluid distribution assembly 150 includes a pump assembly 160 coupled in flow communication with lower spray arm assembly 144 and sump assembly 152. A filter assembly 162 is positioned below lower spray arm assembly 144 and is also in flow communication with pump assembly 160.

Pump assembly 160 defines a pump cavity 172 and a pump inlet 174. A main port 176 and a drain port 178 are coupled in flow communication with pump cavity 172. Pump cavity 172 is in flow communication with a building plumbing system supply line (not shown). Pump cavity 172 is also in flow communication with sump assembly 152 through pump inlet 174. Main port 176 is coupled in flow communication with lower spray arm assembly 144 and further with mid-level spray arm assembly 148, shown in FIG. 1, and/or the upper spray arm assembly through conduit 154, as shown in FIG. 2. Main port 176 is also coupled in flow communication with filter assembly 162 for filtering wash fluid. Drain port 178 is coupled with a soil collection chamber 180 formed within sump assembly 152 through a draining pipe 182. An electric motor (not shown) is positioned within pump assembly 160 for pumping wash fluid from pump cavity 172 selectively to main port 176 or drain port 178.

Figure 4:
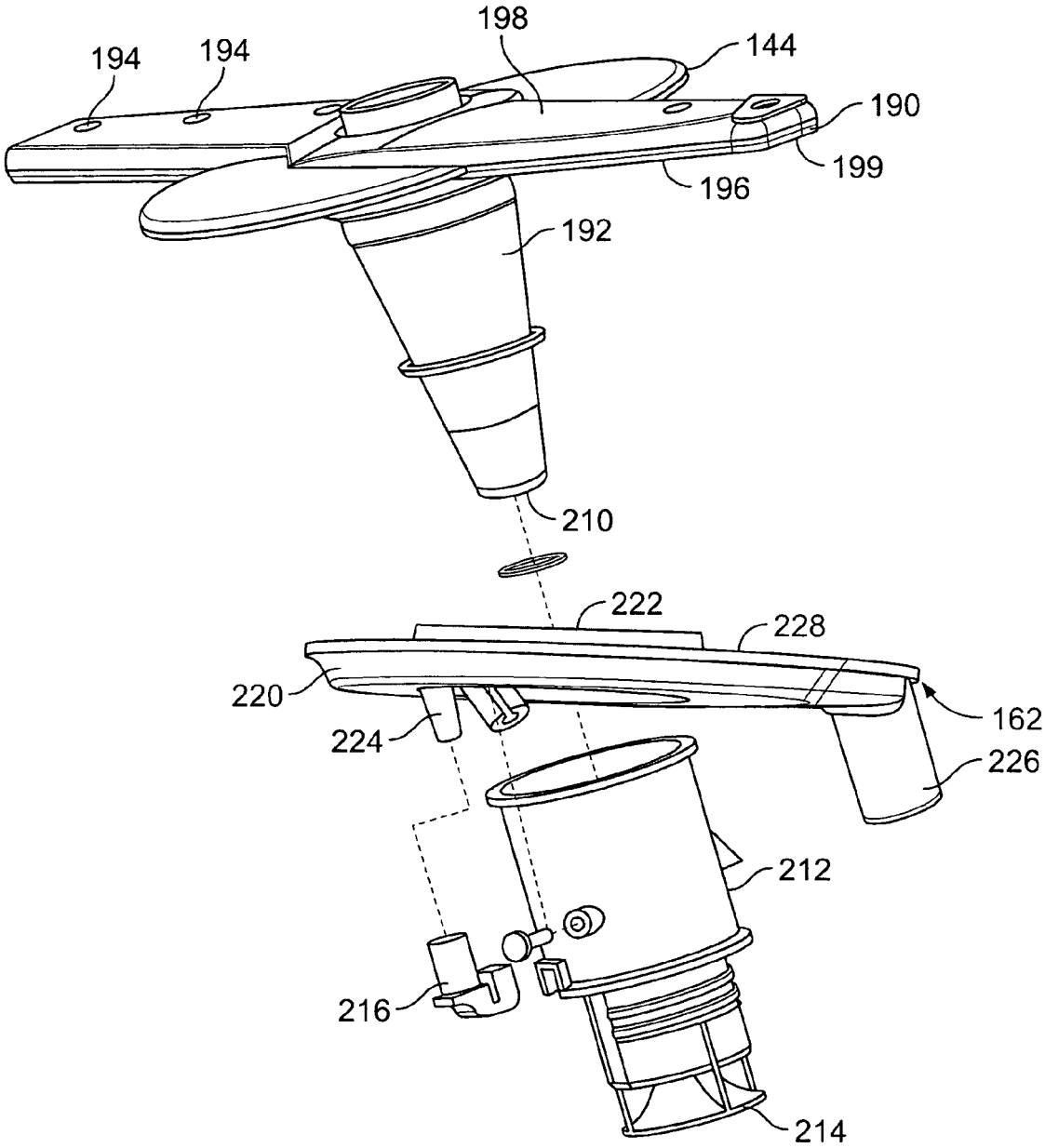
FIG. 4 is an exploded perspective view of a lower spray arm assembly and a filter assembly for the dishwasher system shown in FIG. 1.

FIG. 4 is an exploded perspective view of an exemplary lower spray arm assembly 144 and filter assembly 162. Lower spray arm assembly 144 includes a lower spray arm 190 and a venturi 192 positioned below lower spray arm 190. A plurality of upwardly directed fluid discharge ports 194 and a plurality of downwardly directed fluid discharge ports 196 are defined through an upper surface 198 and a lower surface 199, respectively, of lower spray assembly 190 to facilitate distributing wash fluid throughout wash chamber 106. Venturi 192 is coupled in flow communication with lower spray arm 190 and includes a lower venturi end 210 configured to receive wash fluid from fluid distribution assembly 150.

Lower spray arm assembly 144 also includes a spray arm hub 212 operatively coupled to venturi 192. Spray arm hub 212 includes a lower end 214 coupled in flow communication with main port 176 of pump assembly 160, shown in FIG. 3, for receiving wash fluid. Spray arm hub 212 imparts rotary motion to lower spray arm 190 such that fluid is directed through fluid discharge ports 194, 196 to generate a swirling spray pattern within wash chamber 106. A filter fluid port 216 is coupled to spray arm hub 212, such as at a middle portion of spray arm hub 212, to facilitate directing wash fluid through filter assembly 162. In one embodiment, spray arm hub 212 also includes a second fluid port (not shown) for sealing engagement with conduit 154, shown in FIG. 2, configured to deliver wash fluid to mid-level spray arm assembly 148 and/or the upper spray arm assembly (not shown).

As shown in FIG. 4, filter assembly 162 includes a filter body 220 defining a center opening 222 that is positioned about spray arm hub 212. A filter inlet 224 is defined on an upper portion of filter body 220 and a soil outlet tube 226 extends downward from a lower portion of filter body 220. A filter screen grid 228 is coupled to filter body 220 for filtering soil particles in wash fluid having particle sizes greater than pores or openings defined through filter screen grid 228. In one embodiment, filter body 220 is in flow communication with soil collection chamber 180, as shown in FIG. 3. Filter body 220 and filter screen grid 228 are positioned at an oblique angle configuration with respect to soil collection chamber 180. Filter screen grid 228 is positioned at an oblique angle configuration to facilitate reducing or minimizing prime, i.e., water required to operate the system or to prime pump assembly 160, and reducing or minimizing carryover, i.e., water left in dishwasher system 100 when the drain cycle is completed (undrained water). Filter body 220 is positioned at an oblique angle configuration to facilitate soil transfer into soil collection chamber 180. As such, filter body 220 and filter screen grid 228 generally slope downward from filter inlet 224 towards soil outlet tube 226.

Figure 5:
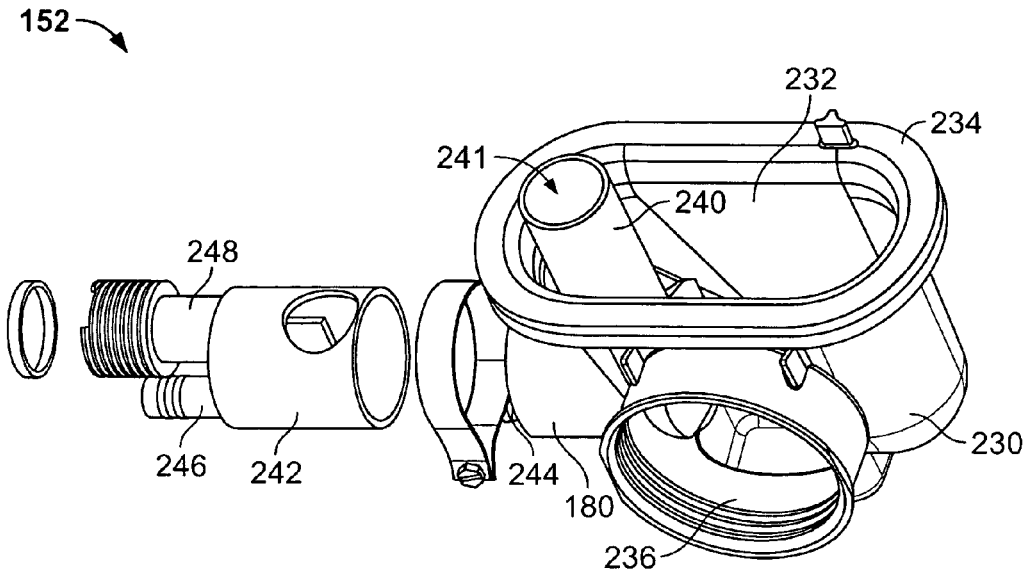
FIG. 5 is an exploded perspective view of a sump assembly for the dishwasher system shown in FIG. 1.

FIG. 5 is an exploded perspective view of an exemplary sump assembly 152. Sump assembly 152 includes sump body 230 defining a sump cavity 232 forming an opening 234. Sump body 230 is coupled to sump portion 142 such that opening 234 provides flow communication between sump portion 142 and sump assembly 152. As such, sump cavity 232 is configured to collect wash fluid from tub 104. Sump body 230 defines a sump outlet 236 coupled in flow communication with pump inlet 174, shown in FIG. 3, for directing or providing wash fluid thereto.

In one embodiment, soil collection chamber 180 is integrally formed within sump body 230 and is isolated from sump cavity 232. A soil inlet tube 240 extends upwardly from soil collection chamber 180 and beyond opening 234 of sump body 230. Soil inlet tube 240 is configured to couple with soil outlet tube 226, shown in FIG. 4, to define a soil drain passage 241 between filter assembly 162 and soil collection chamber 180. As such, soil particles are collected into soil collection chamber 180 through soil drain passage 241. A chamber cap 242 is partially inserted into a chamber opening 244 defined within soil collection chamber 180 to enclose soil collection chamber 180. Chamber cap 242 further includes a drain inlet 246 and a drain outlet 248 defined thereon. Soil collection chamber 180 is positioned within a drain flow path defined between drain inlet 246 and drain outlet 248 to facilitate draining soil particles collected within soil collection chamber 180.

In one embodiment, a cover and/or filter (not shown) are configured to cover opening 234 to prevent undesirable objects from entering sump assembly 152, such as a piece of silverware or an item dropped beneath lower rack 132. In a particular embodiment, a turbidity sensor (not shown) is positioned with respect to sump assembly 152 and configured to sense a level of sediment in sump cavity 232 and/or soil collection chamber 180. The turbidity sensor initiates a drain cycle when a turbidity level in sump assembly 152 reaches or approaches a predetermined threshold level.

Figure 6:
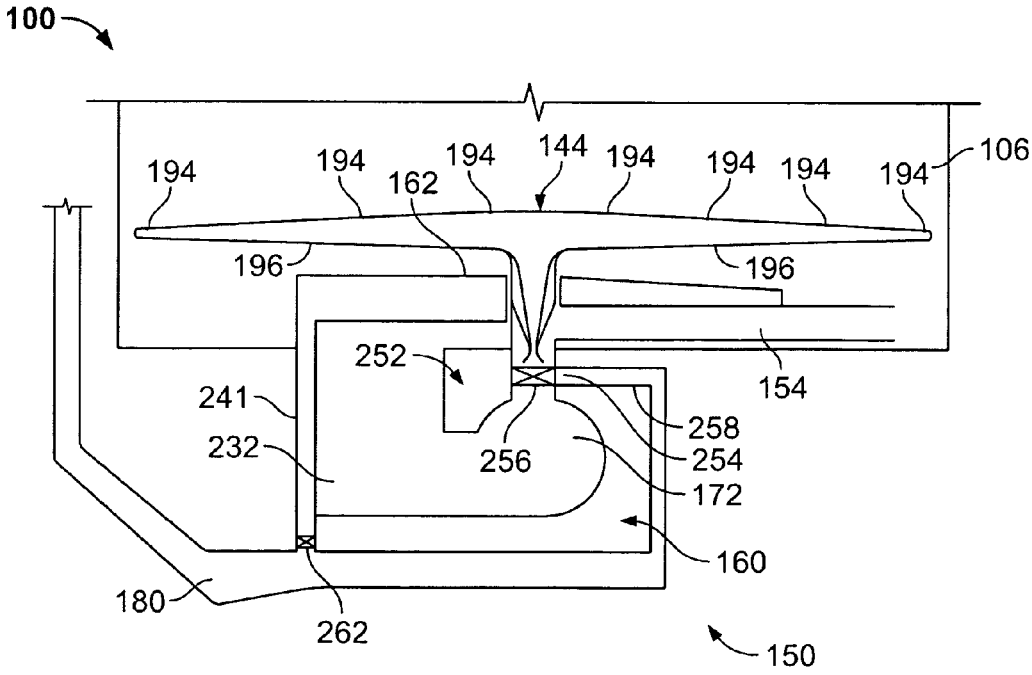
FIG. 6 is a schematic view of the fluid distribution assembly shown in FIG. 3.

FIG. 6 is a schematic view of fluid distribution assembly 150 shown in FIG. 3. A valve assembly 252 is positioned within pump assembly 160 for selectively directing fluid to main port 176 and drain port 178.

Figure 8:
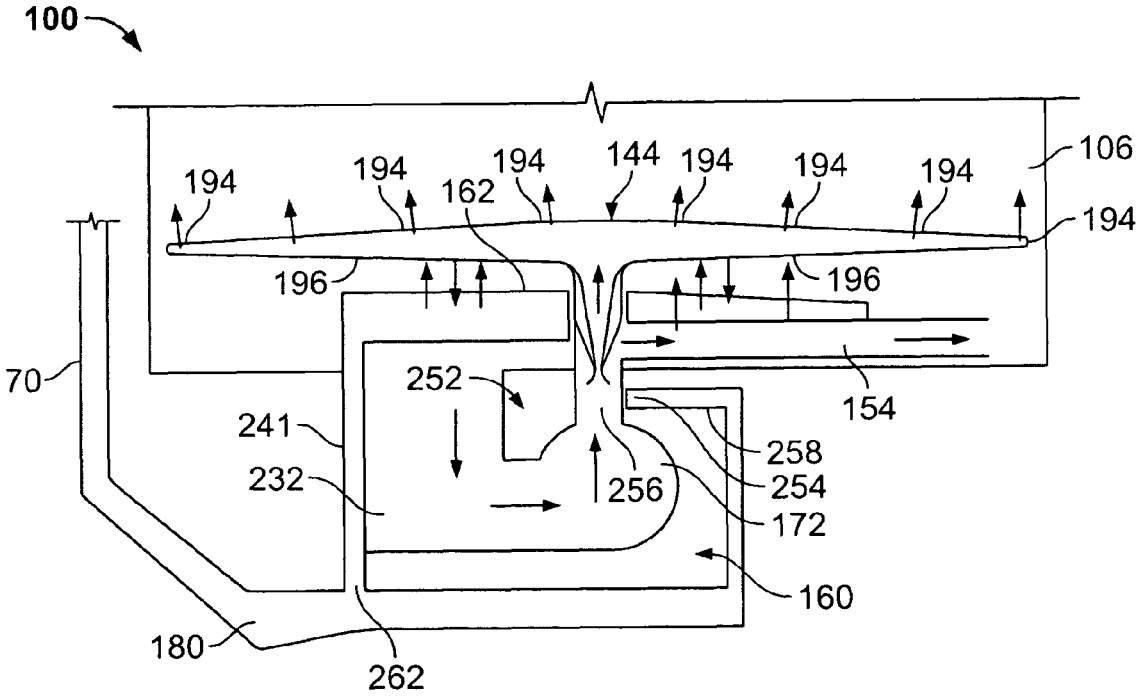
FIG. 8 is a schematic view of the fluid distribution assembly shown in FIG. 3 in the wash cycle.
Figure 10:
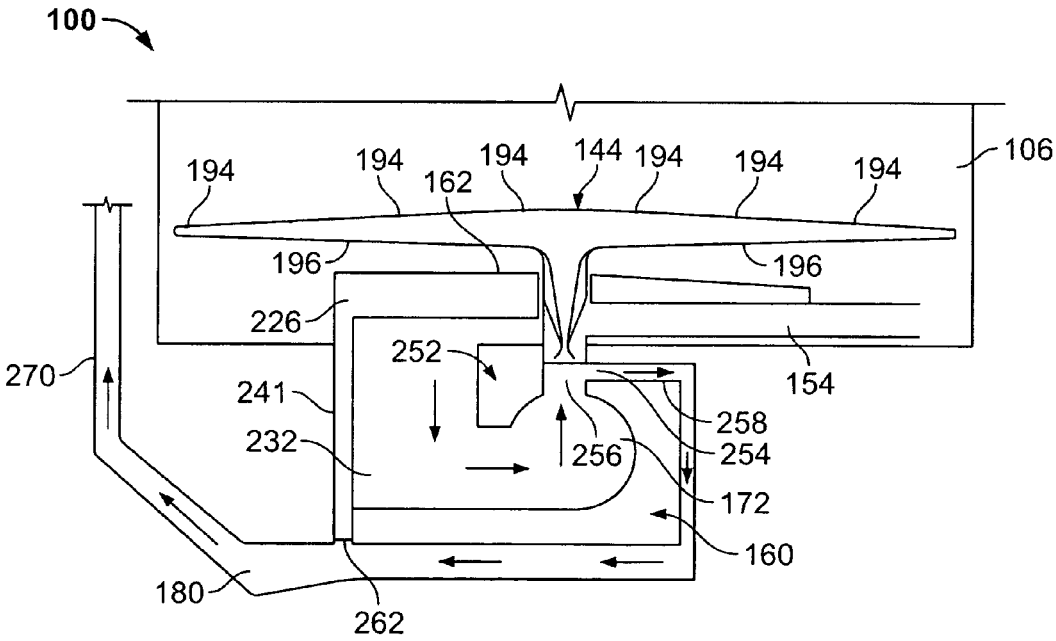
FIG. 10 is a schematic view of fluid distribution assembly shown in FIG. 3 in the drain cycle.

In one embodiment, valve assembly 252 includes a first gate 254, a second gate 256, and a door 258 movable between first gate 254 and second gate 256. First gate 254 provides flow communication between pump cavity 172 and soil collection chamber 180. Second gate 256 provides flow communication between pump cavity 172 and lower spray arm assembly 144 and filter assembly 162. Door 258 moves between a first position, as shown in FIG. 8, and a second position, as shown in FIG. 10, to close the corresponding first gate 254 or second gate 256. As such, when pump assembly 160 is activated to direct wash fluid through valve assembly 252, valve assembly 252 selectively directs wash fluid to soil collection chamber 180 or lower spray arm assembly 144. Specifically, in the first position, valve assembly 252 directs wash fluid to lower spray arm assembly 144 and filter assembly 162. With door 258 in the first position, soil particles move through soil drain passage 241 and are collected in soil collection chamber 180. In the second position, valve assembly 252 directs wash fluid through soil collection chamber 180 such that wash fluid exits dishwasher system 100 through a drain pipe 270.

A check valve 262, such as a ball valve or other suitable valve, is operatively coupled to soil drain passage 241 to regulate fluid flow between filter assembly 162 and soil collection chamber 180. In a particular embodiment, check valve 262 allows fluid flow from filter assembly 162 to soil collection chamber 180, and restricts or prevents fluid flow from soil collection chamber 180 back to filter assembly 162. Valve assembly 252 and check valve 262 cooperate with pump assembly 160 to direct wash fluid through different flow paths in the wash cycle and the drain cycle.

Figure 7:
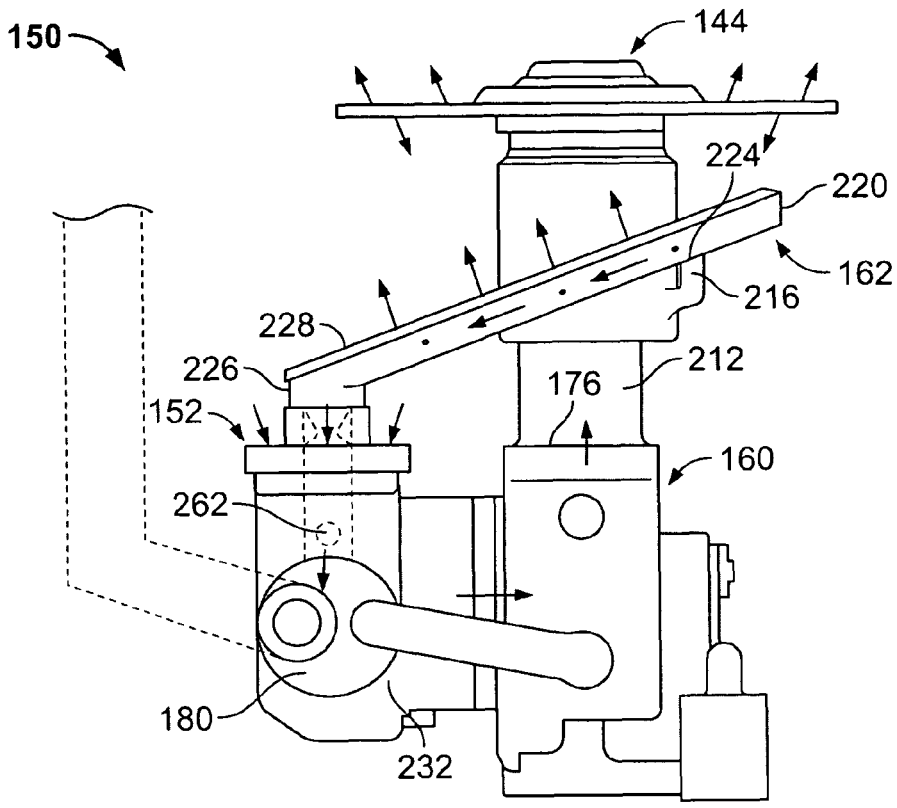
FIG. 7 is a side elevational view of the fluid distribution assembly shown in FIG. 3 in a wash cycle.

FIG. 7 is a side elevational view of fluid distribution assembly 150 shown in FIG. 3 in a wash cycle wherein pump assembly 160 distributes wash fluid throughout wash chamber 106 to facilitate washing and cleaning the contents positioned within wash chamber 106. FIG. 8 is a schematic view of fluid distribution assembly 150 in the wash cycle, wherein wash fluid flow is generally indicated by the corresponding directional arrows.

In the exemplary wash cycle, pump assembly 160 is activated to draw wash fluid from sump cavity 232 into pump cavity 172. Valve assembly 252 moves to the first position to open second gate 256 and close first gate 254. As such, from main port 176, a portion of wash fluid is directed to lower spray arm assembly 144 and a portion of wash fluid is directed to filter assembly 162 through filter fluid port 216 defined on spray arm hub 212. In a further embodiment, wash fluid is also directed through conduit 154 for supplying wash fluid to mid-level spray arm assembly 148 and/or the upper spray arm assembly (not shown).

Wash fluid exits lower spray arm assembly 144 through upwardly directed discharge ports 194 to generate a washing spray in wash chamber 106. Wash fluid flows through downwardly directed fluid discharge ports 196 to create a downward spray on filter assembly 162. In a particular embodiment, wash fluid is also distributed to upper region 149 of wash chamber 106 through mid-level spray arm assembly 148 and the upper spray arm assembly.

Wash fluid is pumped into filter assembly 162 through filter inlet 224 for filtering wash fluid sediment and particles. Sediment and particles incapable of passing through filter screen grid 228 are collected in filter assembly 162. The collected sediment and particle flow downwardly along filter body 220 and into soil outlet tube 226. In one embodiment, filter body 220 and filter screen grid 228 are positioned at an oblique angle configuration with respect to soil collection chamber 180. More specifically, filter body 220 and filter screen grid 228 are positioned at an angle between about 5° and about 75° with respect to a cross-sectional plane defined at soil inlet tube 240 of soil collection chamber 180. As such, filter screen grid 228 is positioned at an oblique angle configuration to facilitate reducing or minimizing prime, i.e., water required to operate the system or to prime pump assembly 160, and reducing or minimizing carryover, i.e., water left in dishwasher system 100 when the drain cycle is completed (undrained water). Filter body 220 is positioned at an oblique angle configuration to facilitate soil transfer into soil collection chamber 180. In alternative embodiments, the oblique angle configuration may be varied.

In one embodiment, downwardly directed discharge ports 196 are positioned to face filter assembly 162. Wash fluid exiting discharge ports 196 is sprayed onto filter assembly 162 to facilitate removing soil particles from filter assembly 162 and/or filter screen grid 228. As such, discharge ports 196 also facilitate transferring soil particles into soil collection chamber 180. As described above, check valve 262 allows soil particles to flow into soil collection chamber 180 through soil drain passage 241. Soil particles are filtered by filter assembly 162 and collected in soil collection chamber 180.

As wash fluid is pumped through lower spray arm assembly 144, mid-level spray arm assembly 148 and the upper spray arm assembly, washing sprays are generated in wash chamber 106, and wash fluid is collected into sump assembly 152 through opening 234. The filtered wash fluid which percolates filter screen grid 228 is also distributed into wash chamber 106 and is collected in sump assembly 152. As such, wash fluid is collected in sump cavity 232 for re-circulation. Wash fluid is re-circulated to lower spray arm assembly 144 through conduit 154 to upper region 149 of dishwasher chamber 106 and to filter assembly 162 for further filtering.

Figure 9:
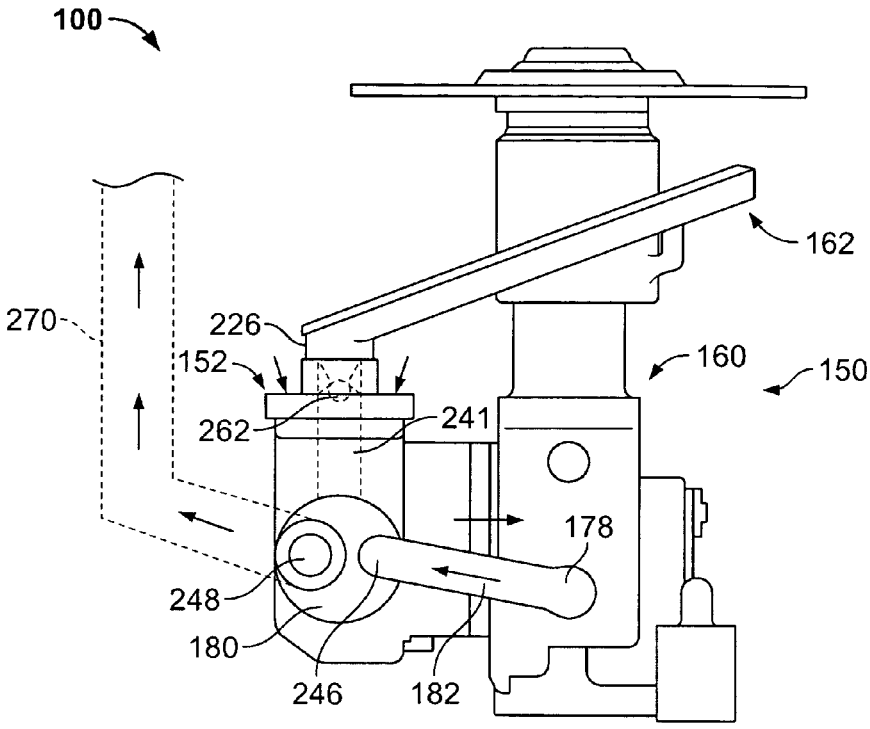
FIG. 9 is a side elevational view of the fluid distribution assembly shown in FIG. 3 in a drain cycle.

FIG. 9 is a side elevational view of fluid distribution assembly 150 shown in FIG. 3 in a drain cycle wherein pump assembly 160 is activated to facilitate draining soil collection chamber 180. FIG. 10 is a schematic view of fluid distribution assembly 150 in the drain cycle. Wash fluid flow is generally indicated by the corresponding directional arrows.

In the exemplary drain cycle, which may be initiated upon detecting a threshold level of turbidity in sump assembly 152, valve assembly 252 moves to the second position to open first gate 254 and close second gate 256. Pump assembly 160 is activated to pump wash fluid from sump cavity 232 through valve assembly 252. As such, from drain port 178, wash fluid is directed to soil collection chamber 180 through drain inlet 246. Wash fluid moves through soil collection chamber 180 and exits soil collection chamber 180 through drain outlet 248. Wash fluid including soil particles is then pumped through a drain pipe 270 coupled with drain outlet 248 and to a building drain system (not shown) coupled to dishwashing system 100. Check valve 262 is biased to a closed position by pressure developed within soil drain passage 241 during the drain cycle. As such, soil particles in soil collection chamber 180 are prevented from flowing back into filter assembly 162 and wash fluid is pumped out of dishwasher system 100.

In one embodiment, the pump assembly directs wash fluid through the valve assembly. The valve assembly then selectively directs wash fluid through the spray arm assembly or the soil collection chamber. As such, a single pump assembly may be used in the wash cycle and the drain cycle. In a particular embodiment, the soil collection chamber is integrally formed with the sump cavity.

While the invention has been described in terms of various specific embodiments, those skilled in the art will recognize that the invention can be practiced with modification within the spirit and scope of the claims.

What is claimed is:

1. A fluid filtration assembly for a dishwasher system including a tub defining a washing chamber configured to receive dishwasher contents, said fluid filtration assembly comprising:

a spray arm assembly configured to distribute fluid within the washing chamber;

a spray arm hub coupled to the spray arm assembly;

a filter assembly comprising a filter body defining a fluid inlet at one end coupled to the spray arm hub and a soil outlet at another end, the fluid inlet being, configured to receive wash fluid from the spray arm hub;

a soil collection chamber coupled in flow communication with said soil outlet at the another end of the filter body and configured to receive soil filtered by said filter assembly;

wherein the filter body extends between the spray arm hub and the soil collection chamber with the fluid inlet being disposed higher relative to the soil outlet, and the filter body is angled relative to the spray arm hub and the soil collection chamber;

a single pump assembly coupled between the spray arm hub and the soil collection chamber and configured to direct fluid to one of the spray arm assembly and said soil collection chamber, said single pump assembly defining a pump cavity;

a valve assembly movable between a first position and a second position, wherein said valve assembly is coupled in flow communication with the spray arm assembly and said soil collection chamber, with said valve assembly in the first position, said pump assembly is configured to direct fluid to the spray arm assembly, and with said valve assembly in the second position, said pump assembly is configured to direct fluid only into said soil collection chamber, wherein said valve assembly prevents flow communication between the spray arm assembly and said pump assembly when said valve assembly is in the second position, the valve assembly being disposed within the pump assembly; and a check valve separate from the valve assembly and in flow communication with the soil outlet and soil collection chamber and configured to regulate fluid flow between said filter assembly and said soil collection chamber.

2. A fluid filtration assembly in accordance with claim 1 wherein said valve assembly comprises a first gate selectively providing flow communication between said pump assembly and said soil collection chamber, a second gate selectively providing flow communication between said pump assembly and said spray arm assembly, and a door movable to close one of said first gate and said second gate.

3. A fluid filtration assembly in accordance with claim 1 wherein said filter assembly further comprises a screen positioned within said filter body and configured to filter soil particles, said screen positioned at an oblique angle configuration with respect to an inlet of said soil collection chamber to facilitate at least one of priming the pump assembly and reducing carryover.

4. A fluid filtration assembly in accordance with claim 1 further comprising a sump integrally formed with said soil collection chamber, said sump positioned with respect to a bottom portion of the tub and configured to collect fluid exiting, said spray arm assembly.

5. A fluid filtration assembly in accordance with claim 4 wherein said pump assembly is configured to pump fluid from said sump through said valve assembly.

6. A fluid filtration assembly in accordance with claim 1 wherein the spray arm assembly comprises at least one fluid discharge port defined thereon and facing said filter assembly.

7. A fluid filtration assembly in accordance with claim 1 wherein said pump assembly is configured to direct fluid to said filter assembly with said valve assembly in the first position.

8. A fluid filtration assembly according to claim 1, further comprising a drain port line coupling the valve assembly with the soil collection chamber, wherein when the valve assembly is in the second position, the pump assembly is configured to direct fluid through the drain port line into said soil collection chamber.

9. The fluid filtration system of claim 1, wherein the spray arm assembly comprise an upper spray atm assembly and a lower spray arm assembly.

10. The fluid filtration system of claim 1, comprising a fluid port on the spray arm hub coupled to the fluid inlet, on the filter body, wherein fluid from the pump assembly is directed into the filter assembly through the spray arm hub.

11. The fluid filtration system of claim 1, wherein the valve assembly is disposed within the pump assembly below a lower portion of the spray arm assembly and above said pump cavity.

12. A dishwasher comprising:

a tub defining a wash chamber;

a spray arm assembly positioned within said wash chamber and configured to distribute fluid within said wash chamber;

a filter assembly positioned within said wash chamber, said filter assembly comprising at one end a fluid inlet, coupled to the spray arm assembly and at another end a drain tube, the drain tube coupled in flow communication with said fluid inlet;

a soil collection chamber coupled in flow communication with said drain tube and configured to receive filtered particles from said filter assembly, the filter assembly being angled relative to the spray arm assembly and the soil collection chamber, the one end of the filter assembly with the fluid inlet coupled to the spray arm assembly being disposed higher relative to the other end of the filter assembly;

a single pump assembly configured to selectively direct fluid through the spray arm assembly and through said soil collection chamber, said pump assembly defining a pump cavity;

a valve assembly movable between a wash position and a drain position, in said wash position said valve assembly providing flow communication between said pump assembly and the spray arm assembly and in said drain position said valve assembly providing, flow communication only between said pump assembly and said soil collection chamber, wherein said valve assembly prevents flow communication between said pump assembly and said soil collection chamber when said valve assembly is in said wash position, and wherein the valve assembly is disposed within the pump assembly; and a check valve separate from the valve assembly and in flow communication with the drain tube and the soil collection chamber and configured to restrict fluid flow from said soil collection chamber to said filter assembly.

13. A dishwasher in accordance with claim 12 wherein said valve assembly comprises a first gate providing flow communication between said pump assembly and said soil collection chamber, a second gate providing flow communication between said pump assembly and said spray arm assembly, and a door movable to close one of said first gate and said second gate.

14. A dishwasher in accordance with claim 12 wherein said filter assembly further comprises a filter body and a screen positioned within said filter body and configured to filter soil particles, said filter body positioned at an oblique angle configuration with respect to an inlet of said soil collection chamber to facilitate soil transfer into said soil collection chamber and said screen positioned at an oblique angle configuration with respect to the inlet to facilitate at least one of priming said pump assembly and reducing carryover.

15. A dishwasher in accordance with claim 12 further comprising a sump integrally formed with said soil collection chamber, said sump positioned within said wash chamber and configured to collect fluid exiting said spray arm assembly.

16. A dishwasher in accordance with claim 12 wherein the spray arm assembly further comprises at least one fluid discharge port configured to direct fluid towards said filter assembly.

17. A dishwasher in accordance with claim 12 wherein said soil collection chamber further comprises a drain outlet coupled in flow communication with a drain.

18. A dishwasher in accordance with claim 12, further comprising a drain port line coupling the valve assembly with the soil collection chamber, wherein when the valve assembly is in the drain position, the pump assembly is configured to direct fluid through the drain port line into said soil collection chamber.

19. The dishwasher of claim 12, wherein the spray arm assembly comprise an upper spray arm assembly and a lower spray arm assembly.

20. The dishwasher of claim 12, comprising a fluid port on the spray arm assembly coupled to the fluid inlet on the filter body, wherein fluid from the pump assembly is directed into the filter assembly through the spray arm assembly.

* * * * *